US010076781B1

(12) United States Patent
Lee

(10) Patent No.: US 10,076,781 B1
(45) Date of Patent: Sep. 18, 2018

(54) AUTOMATIC PROCESSING PRESS

(71) Applicant: John D. Lee, Hartford, WI (US)

(72) Inventor: John D. Lee, Hartford, WI (US)

( * ) Notice: Subject to any disclaimer, the term of this patent is extended or adjusted under 35 U.S.C. 154(b) by 0 days.

(21) Appl. No.: 15/813,524

(22) Filed: Nov. 15, 2017

(51) Int. Cl.
*F42B 33/10* (2006.01)
*B21K 1/02* (2006.01)
*F42B 33/04* (2006.01)

(52) U.S. Cl.
CPC ..... *B21K 1/025* (2013.01); *F42B 33/10* (2013.01); *F42B 33/04* (2013.01)

(58) Field of Classification Search
CPC ..... F42B 33/10; F42B 33/12; F42B 33/004; F42B 33/005
USPC ..... 86/19.6
See application file for complete search history.

(56) References Cited

U.S. PATENT DOCUMENTS 3,113,483 A * 12/1963 Puth ..... F42B 33/004 86/23
3,157,086 A * 11/1964 Bachhuber ..... F42B 33/004 86/27
4,133,249 A * 1/1979 Bachhuber ..... F42B 33/10 86/23

FOREIGN PATENT DOCUMENTS

FR 1.224.060 * 2/1960

* cited by examiner

*Primary Examiner* — Stephen Johnson
(74) *Attorney, Agent, or Firm* — Donald J. Ersler

(57) ABSTRACT

An automatic processing press preferably includes a lower die carrier, a pair of support posts, an upper die carrier, an actuation device, a case slider and an automatic feeder magazine. The lower die carrier preferably includes a base portion. The case slider is slidably retained on the case slider support. The automatic feeder magazine includes a feed plate, a tube holder and a threaded stud. The threaded stud is retained by the base portion of the lower die carrier. The pair of support posts are retained in the base portion. The upper die carrier is slidably retained on the pair of support posts. The actuation device is pivotally engaged with the upper die carrier and the lower die carrier to move the upper die carrier downward. A bullet resizing die system and a case resizing die system are capable of being threaded into the upper and lower die carriers.

15 Claims, 8 Drawing Sheets

FIG. 17
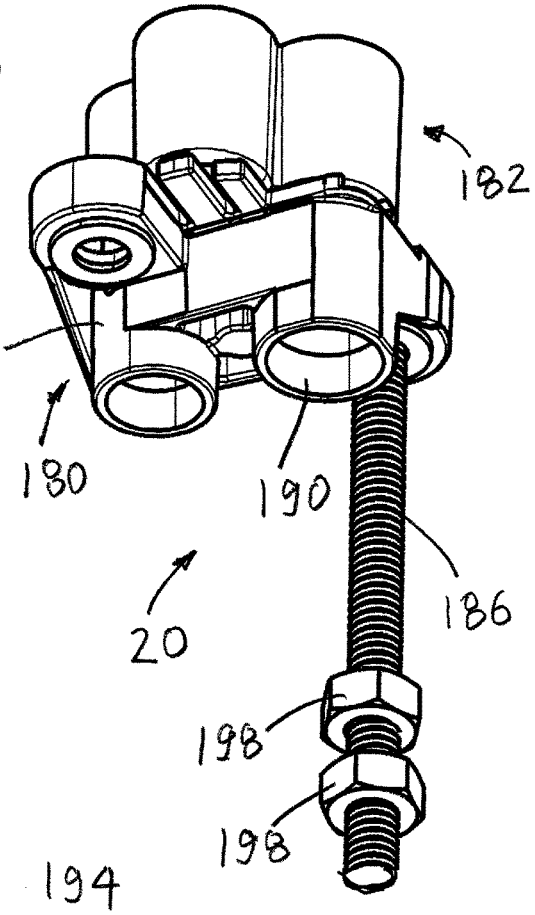
FIG. 18
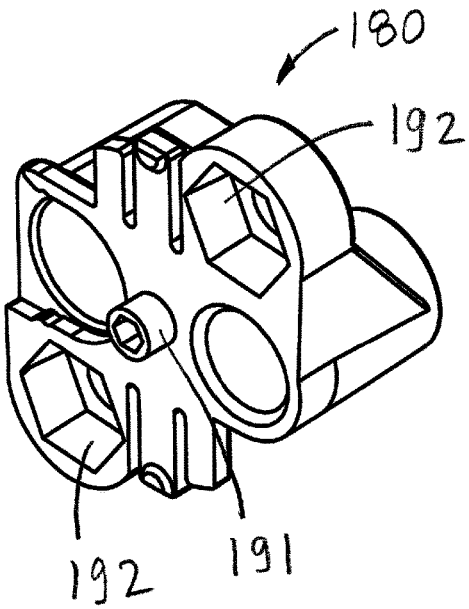
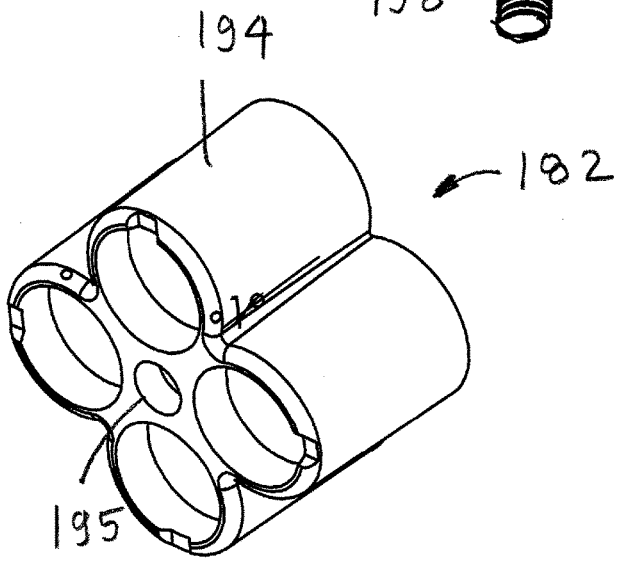
FIG. 19

AUTOMATIC PROCESSING PRESS

BACKGROUND OF THE INVENTION

1. Field of the Invention

The present invention relates generally to firearms and more specifically to an automatic processing press, which allows a bullet sizing die to be mounted in an upper die carrier or a lower die carrier; and which includes a novel automatic feeder magazine.

2. Discussion of the Prior Art

Since the early 1950's reloading presses have conventionally used a ⅞-14 thread for affixing reloading dies into the reloading press for various operations including case resizing, case neck expansion and bullet seating. Another operation performed on reloading presses is bullet or projectile sizing. All presses in the past have the press configured with the ⅞-14 threaded receiver mounted opposed to a reciprocating ram and the threaded receiver is almost universally located above the reciprocating ram. In some instances the threaded receiver is affixed to a carrier and is lowered and raised relative to what is known as a shell holder. This shell holder would normally be attached to the reciprocal ram but in the instance of a reciprocal carrier the shell holder is affixed to the base and the reciprocal ram eliminated.

It is desirable to have a press with a ⅞-14 threaded receiver in both upper and lower positions in the press. The ability to mount the die in the upper or lower positions allows the user to place the die in use in the most convenient and efficient position. In addition the ability to keep the shell holder in an immovable position allows an automatic feeding device to be easily utilized. The automatic feeding device would be of a new design that would allow feeding and accurate placement of a variety of cartridge case diameters and projectile diameters with out adjustment. The new automatic feeder magazine will also allow the use of a new type of shell holder, which may be called a "pass through" shell holder.

An example of a more efficient die location would be a bullet or projectile sizing die. Users of bullet sizing dies actually go to the extreme measure of fabricating mounting brackets to mount their reloading press inverted to allow the sized projectile to drop freely from the sizing die into a catch container. Customarily the sizing die is mounted in the upper ⅞-14 die receiver and the punch is installed into the shell holder receiving slot. The projectile is forced through the sizing die and exits the die out of the top. Some projectiles because of their shape will stack and cause a covered catch container to lift from the die spilling its contents. The user must manually place each bullet on the punch and operate the lever of the press being careful to not have his fingers between the punch and die.

Accordingly, there is a clearly felt need in the art for an automatic processing press, which allows a bullet sizing die to be mounted in an upper ram or a lower ram; and which includes a novel automatic feeder magazine.

SUMMARY OF THE INVENTION

The present invention provides an automatic processing press, which provides bullet sizing and allows spent primers to be removed from a cartridge case. The automatic processing press preferably includes a lower die carrier, a pair of support posts, an upper die carrier, an actuation device, a case slider and an automatic feeder magazine. The lower die carrier preferably includes a base portion, a mounting flange, a funnel projection and a case slider support. The base portion includes a threaded die receiver, a pair of post counter bores, and two mounting holes. The threaded die receiver is formed through base portion, adjacent a front of the base portion. The threaded die receiver is sized to threadably receive a lower threaded die. The two mounting holes are formed through the base portion, adjacent a rear of the base portion. The pair of post counter bores are formed between the threaded die receiver and the two mounting holes. The pair of post counter bores are sized to receive the pair of support posts. The mounting flange extends from a rear of the base portion. The mounting flange includes at least one flange mounting hole. The funnel projection extends from a front of the base portion. The funnel projection includes a peripheral wall and a funnel portion. The peripheral wall surrounds most of a perimeter of the threaded die receiver. The funnel portion communicates with an open area adjacent the peripheral wall. The funnel portion preferably includes a tapered cavity with an exit tube extending from a bottom of the tapered cavity.

The case slider support extends from the base portion and from a side opposite the funnel projection. The case slider support includes a support plate and a gusset support extending from a bottom of the support plate and a side of the base portion. A feed boss extends backward from the case slider support. A stud hole is formed through the feed boss to receive a threaded rod of the automatic feeder magazine.

The case slider preferably includes a slider base, an inner jaw, an outer jaw, a jaw actuator and a slider cover. The slider base preferably includes a base plate, a pair of opposing sides, a pair of inward facing capture projections, a pivot boss and a stop pin. The pair of opposing sides extend downward from opposing sides of the base plate. The pair of inward facing capture projections extend inward from a bottom of the pair of opposing sides. The stop pin extends upward from a top and end of the base plate. The pivot boss is located adjacent the stop pin. A pair of slide slots are formed through the base plate adjacent the pair of opposing sides. The inner jaw preferably includes an inner base plate, an inner crank pin, an inner clamp member and an inner slide pivot pin. The inner crank pin extends upward from one side and one end of the inner base plate. The inner slide pivot pin extends downward from the one end and an opposing side of the inner base plate. The inner clamp member extends upward from an opposing end and the one side of the base plate. An inner semi-circular slot is formed in the opposing side of the base plate and between the inner crank pin and the inner clamp member, which sized to receive the stop pin.

The outer jaw preferably includes an outer base plate, an outer crank pin, an outer clamp member and an outer pivot pin. The outer crank pin extends upward from one side and one end of the outer base plate. The outer pivot pin extends downward from the one end and an opposing side of the outer base plate. The outer clamp member extends upward from an opposing end and the one side of the base plate. An outer semi-circular slot is formed in the opposing side of the base plate and between the outer crank pin and the outer clamp member, which sized to receive the stop pin. A clamp projection extends outward from the opposing end and opposing side of the outer base plate. The jaw actuator preferably includes a jaw base plate and a spring pin. The jaw base plate includes an actuation plate and a spring plate. One end of the spring plate extends from one end of the actuation portion. The spring pin is attached to an opposing end of the spring plate. A slide opening is formed in a middle of the actuation plate at substantially one end thereof. An outer slot is formed in one corner at an opposing end of the actuation plate and an inner slot is formed in an opposing corner at the opposing end of the actuation plate.

The inner jaw is placed on one side of the base plate and the outer jaw is placed on an opposing side of the base plate. The jaw actuator is laid over the inner and outer jaws, such that the inner and outer crank pins are received by the inner and outer slots. The slide opening of the jaw actuator receives the pivot boss of the base plate. The slider base is slid on to the case slider support. The slider cover includes a jaw actuator slot and a spring deflector projection. The jaw actuator slot is formed in a bottom of the slider cover and is sized to receive the motion of the jaw actuator. The spring deflector projection extends from a side of the slider cover. The spring deflector projection prevents an extension spring from interfering with a motion of the inner and outer jaws. The slider cover is secured to a top of slider base with at least one fastener.

The upper die carrier includes an upper base portion, a pair of post bosses and a spring retention projection. The post bosses preferably extend downward from upper base portion. A post bore is formed through each post boss. The post bore is sized to receive one of the pair of support posts. An upper threaded receiver is formed through upper die carrier to receive an upper threaded die. The spring retention projection extends outward from a front of the upper base portion. One end of an extension spring is retained on the spring retention projection and the other end is retained on the spring pin. The actuation device preferably includes a pull handle and a pair of toggle links. The pull handle includes a handle member and a pair leverage links. The handle member is attached between one end of the pair of leverage links. An opposing end of the pair of leverage links are pivotally engaged with one end of the pair of toggle links. The upper die carrier is pivotally retained between the pair of leverage links substantially adjacent the opposing end of the pair of leverage links. An opposing end of the pair of toggle links are pivotally engaged with opposing sides of the base portion of the lower die carrier.

A bullet resizing die system preferably includes a universal shell holder adapter, a bullet sizer punch and a bullet resizing die. The universal shell holder adapter includes a threaded body, and a retention slot. The threaded body preferably has a ⅞-14 thread. The retention slot is sized to retain a punch flange of the bullet sizer punch. The bullet sizer punch includes a flange and a punch diameter, which is sized to be inserted into an inner diameter of a bullet resizing die. The bullet resizing die includes a threaded body, a tapered inner diameter and a clearance diameter. The tapered inner diameter is tapered to a specific bullet diameter. The clearance diameter extends from a bottom of the tapered inner diameter. The universal shell holder adapter and the bullet resizing die are threadably engaged with a threaded die receiver of the lower die carrier or upper threaded receiver of the upper die carrier.

A case resizing die system preferably includes a cartridge resizing die, a pass through shell holder and the universal shell holder adapter. The cartridge resizing die includes a threaded body, a concentrically positioned deprimer punch and a deprimer punch hollow bolt. The threaded body includes a punch counter bore formed in one end and a primer threaded tap formed in the opposing end. The deprimer punch hollow bolt includes an inner diameter that is sized to receive concentrically positioned deprimer punch. The primer threaded tap is sized to threadably receive the primer punch hollow bolt. The pass through shell holder includes a retention flange, a shell holder slot and a through diameter. The shell holder slot is sized to retain a specific size of cartridge casing. The retention flange is sized to be retained by the retention slot of the universal shell holder adapter. The universal shell holder adapter and the cartridge resizing die are threadably engaged with a threaded die receiver of the lower die carrier or upper threaded receiver of the upper die carrier.

The automatic feeder magazine preferably includes a feed plate, a tube holder, a plurality of feed tubes and a threaded stud. The feed plate includes a pair of tubes extending from a bottom thereof. Each tube includes two different inner diameters for receiving two different size shells. An anchor cavity is formed in the top of the feed plate to receive and retain one end of a threaded stud. A tube holder preferably includes four cylinders for receiving and retaining four feed tubes. Each feed tube includes an inner diameter, which is sized to receive the largest cartridge casing used. The tube holder is rotatably retained on the feed plate. The other end of the threaded stud is inserted in a hole in the feed boss of the lower die carrier to support the automatic feeder magazine, and is retained at the proper height with a jamb nut above and below the hole on lower die carrier.

Accordingly, it is an object of the present invention to provide an automatic processing press, which allows a bullet sizing die to be mounted in an upper ram or a lower ram; and which includes a novel automatic feeder magazine.

These and additional objects, advantages, features and benefits of the present invention will become apparent from the following specification.

BRIEF DESCRIPTION OF THE DRAWINGS

FIG. 17 is a bottom perspective view of an automatic feeder magazine of an automatic processing press in accordance with the present invention.

FIG. 18 is a top perspective view of a feed plate of an automatic feeder magazine of an automatic processing press in accordance with the present invention.

FIG. 19 is a bottom perspective view of a tube holder of an automatic feeder magazine of an automatic processing press in accordance with the present invention.

DETAILED DESCRIPTION OF THE PREFERRED EMBODIMENTS

Figure 1:
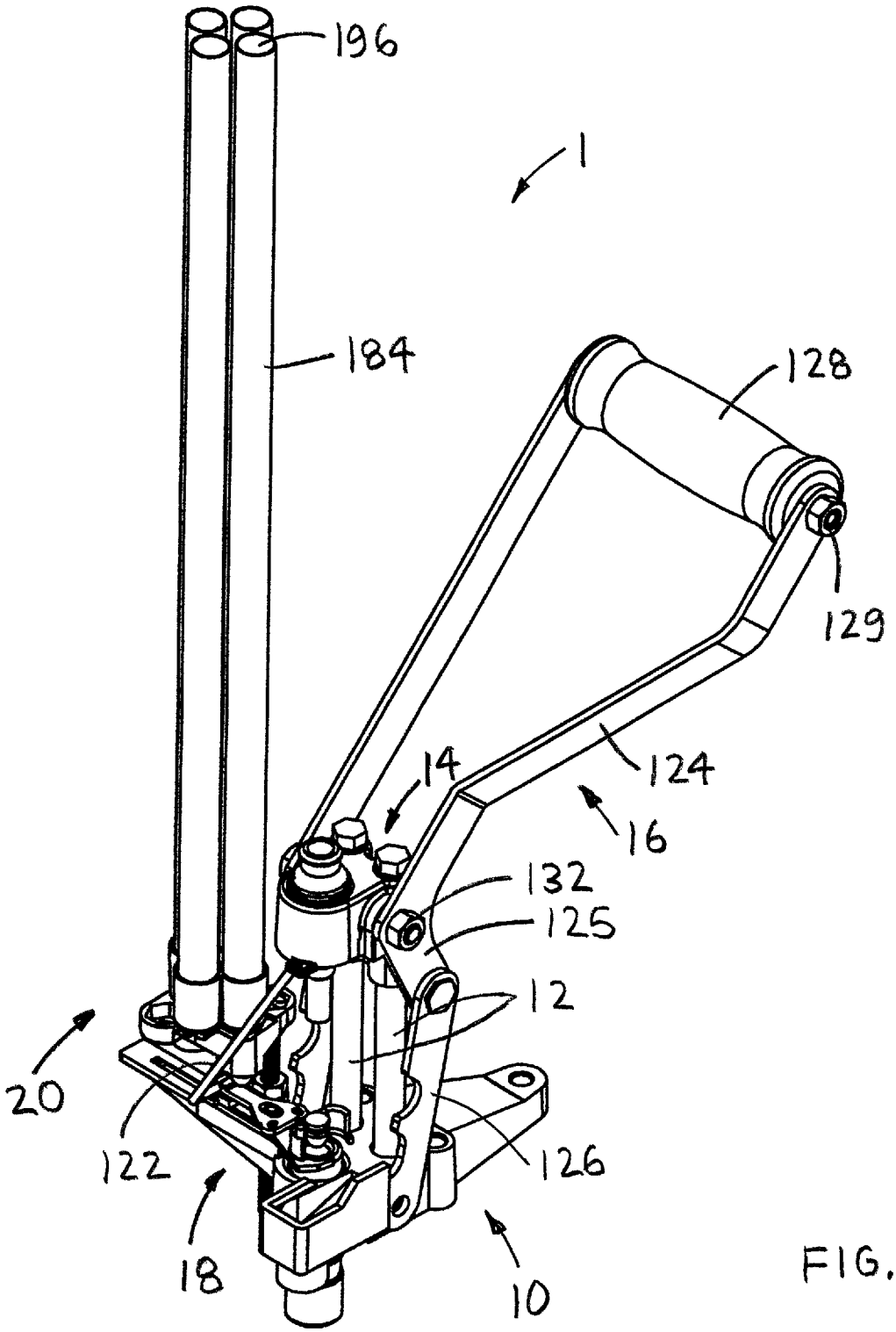
FIG. 1 is a perspective view of an automatic processing press in accordance with the present invention.
Figure 2:
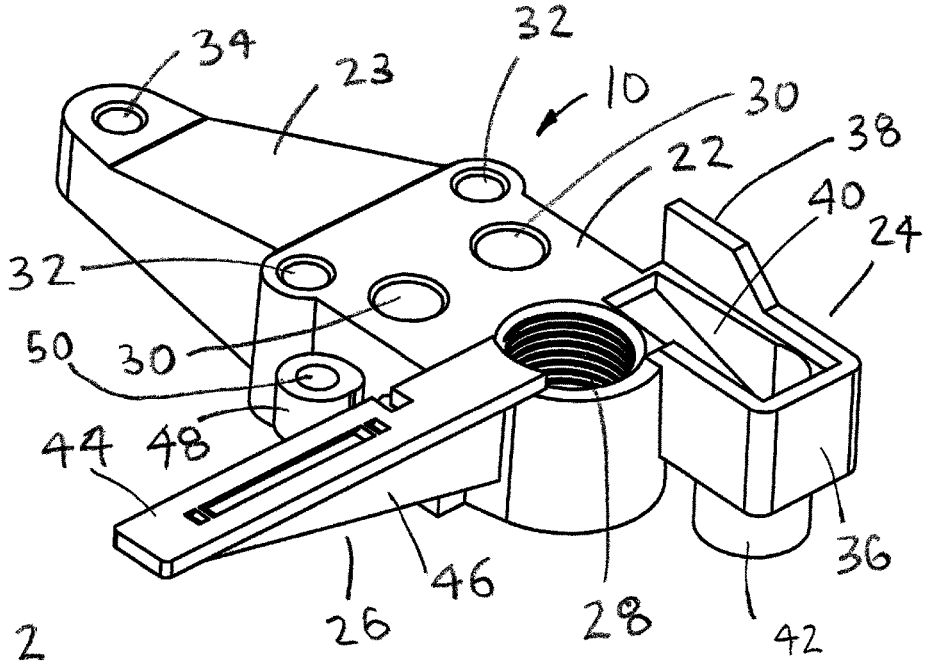
FIG. 2 is a perspective view of lower die carrier of an automatic processing press in accordance with the present invention.
Figure 3:
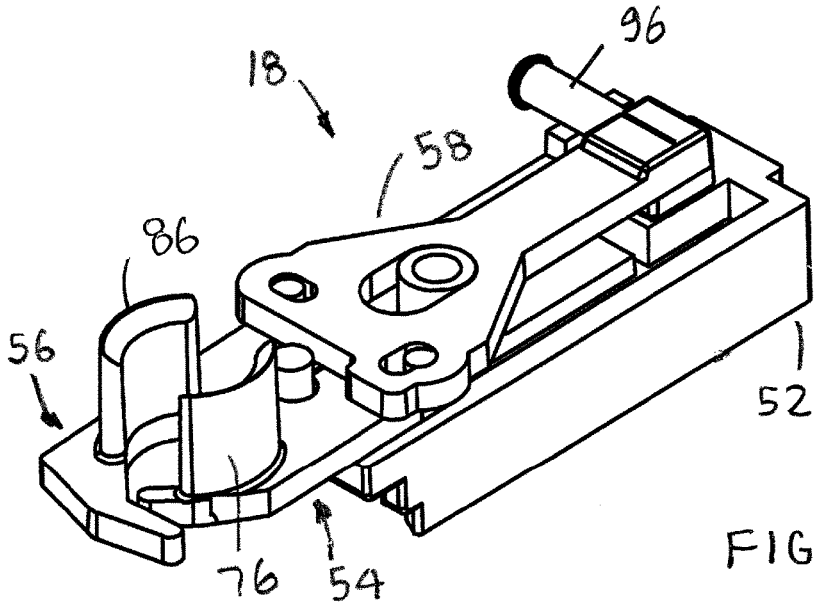
FIG. 3 is a perspective view of a case slider without a cover of an automatic processing press in accordance with the present invention.
Figure 4:
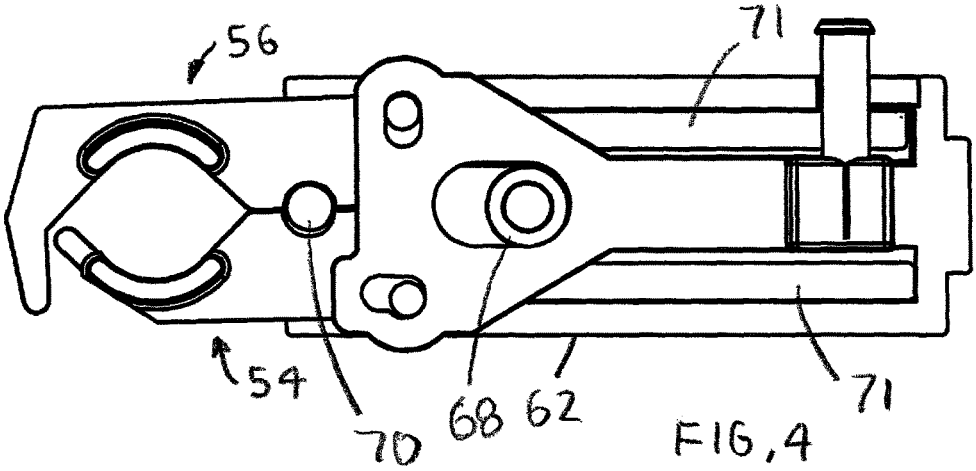
FIG. 4 is a top view of a case slider without a cover in a closed orientation of an automatic processing press in accordance with the present invention.
Figure 5:
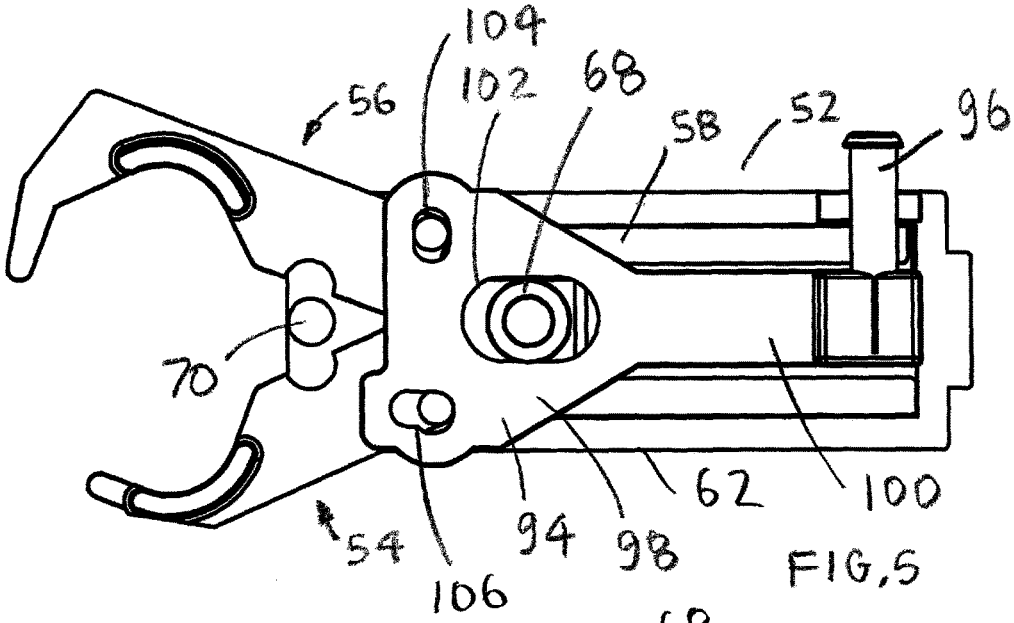
FIG. 5 is a top view of a case slider without a cover in an open orientation of an automatic processing press in accordance with the present invention.
Figure 6:
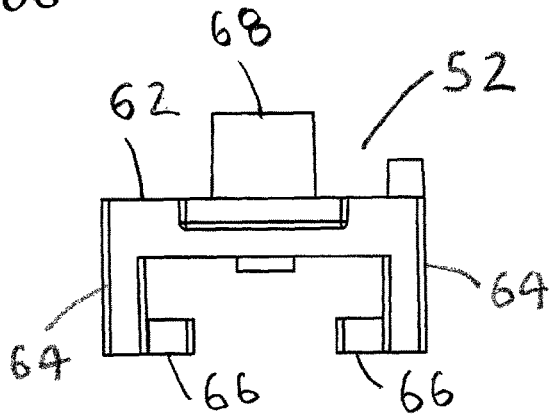
FIG. 6 is an end view of a slider base of a case slider of an automatic processing press in accordance with the present invention.
Figure 7:
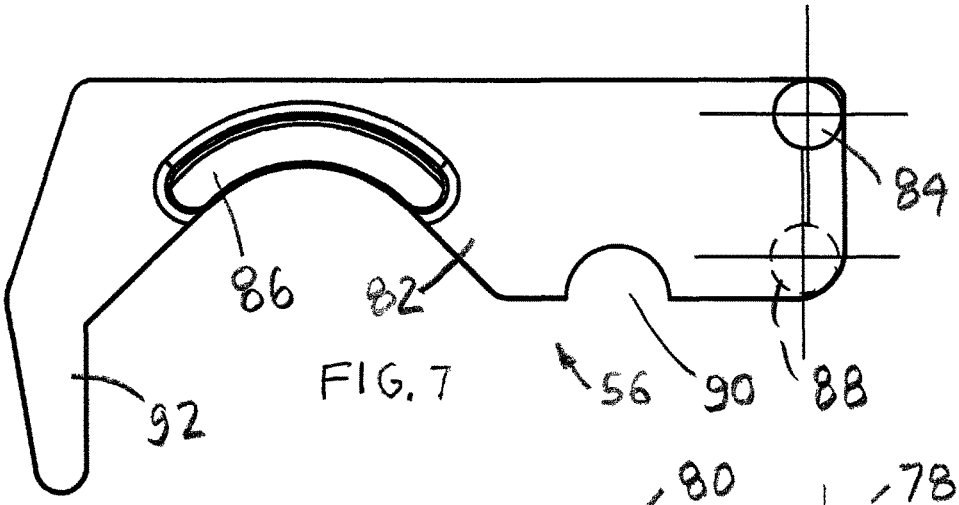
FIG. 7 is a top view of an outer jaw of a case slider of an automatic processing press in accordance with the present invention.
Figure 8:
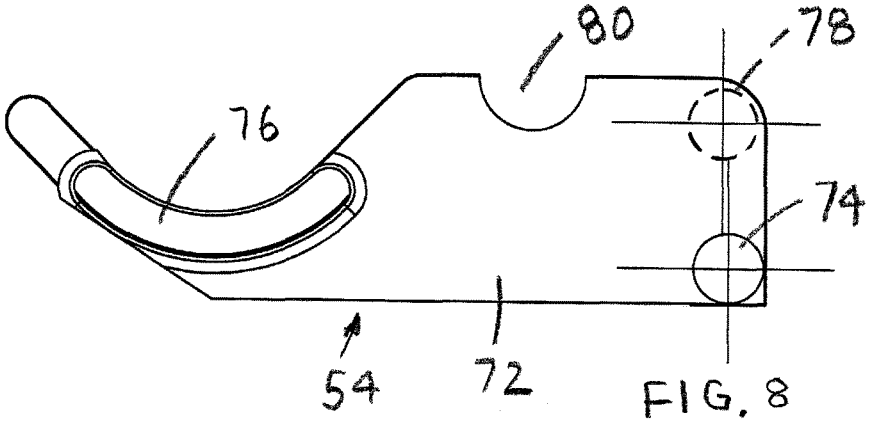
FIG. 8 is a top view of an inner jaw of a case slider of an automatic processing press in accordance with the present invention.
Figure 9:
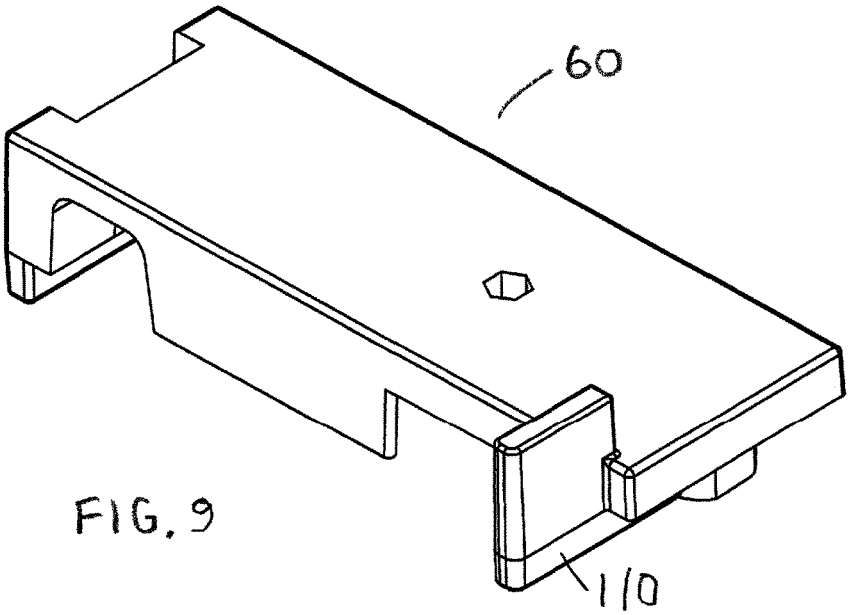
FIG. 9 is a perspective view of a cover of a case slider of an automatic processing press in accordance with the present invention.
Figure 9A:
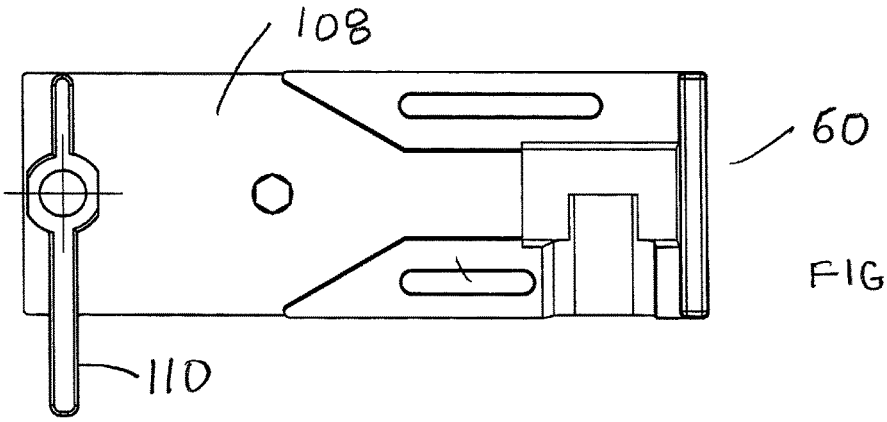
FIG. 9*a* is a bottom view of a cover of a case slider of an automatic processing press in accordance with the present invention.

With reference now to the drawings, and particularly to FIG. 1, there is shown a perspective view of an automatic processing press 1. The automatic processing press 1 preferably includes a lower die carrier 10, a pair of support posts 12, an upper die carrier 14, an actuation device 16, a case slider 18 and an automatic feeder magazine 20. With reference to FIG. 2, the lower die carrier 10 preferably includes a base portion 22, a mounting flange 23, a funnel projection 24 and a case slider support 26. The base portion 22 includes a threaded die receiver 28, a pair of post counter bores 30, and two mounting holes 32. The threaded die receiver 28 is formed through the base portion 22, adjacent a front of the base portion 22. With reference to FIGS. 12-17, the threaded die receiver 28 is sized to threadably receive a universal shell holder adapter, a bullet resizing die or a cartridge resizing die. The two mounting holes 32 are formed through the base portion 22, adjacent a rear of the base portion 22. The pair of post counter bores 30 are formed between the threaded die receiver 28 and the two mounting holes 32. The pair of post counter bores 30 are sized to receive the pair of support posts 12. The mounting flange 23 extends from a rear of the base portion 22. The mounting flange 23 includes at least one flange mounting hole 34.

The funnel projection 24 extends from a front of the base portion 22. The funnel projection 24 includes a peripheral wall 36 and an impact guard 38. The funnel portion 38 communicates with an open area created by the peripheral wall 36. The funnel projection 24 preferably includes a tapered cavity 40 with an exit tube 42 extending from a bottom of the tapered cavity 40. The case slider support 26 extends from the base portion 22 and from a side opposite the funnel projection 24. The case slider support 26 includes a support plate 44 and a gusset support 46 extending from a bottom of the support plate 44 and a side of the base portion 22. A feed boss 48 extends backward from the case slider support 26. A stud hole 50 is formed through the feed boss 48 to threadably receive a threaded rod of the automatic feeder 20.

With reference to FIGS. 3-9*a*, the case slider 18 preferably includes a slider base 52, an inner jaw 54, an outer jaw 56, a jaw actuator 58 and a slider cover 60. The slider base 52 preferably includes a base plate 62, a pair of opposing sides 64, a pair of inward facing capture projections 66, a pivot boss 68 and a stop pin 70. The pair of opposing sides 64 extend downward from opposing sides of the base plate 62. The pair of inward facing capture projections 66 extend inward from a bottom of the pair of opposing sides 64. The stop pin 70 extends upward from a top and end of the base plate 62. The pivot boss 68 is located adjacent the stop pin 70. A pair of slide slots 71 are formed through the base plate 62 adjacent the pair of opposing sides 64. The inner jaw 54 preferably includes an inner base plate 72, an inner crank pin 74, an inner curved clamp member 76 and an inner slide pivot pin 78. The inner crank pin 74 extends upward from one side and one end of the inner base plate 72. The inner slide pivot pin 78 extends downward from the one end and an opposing side of the inner base plate 72. The inner clamp member 76 extends upward from an opposing end and the one side of the base plate 72. An inner semi-circular slot 80 is formed in the opposing side of the base plate 72 and between the inner crank pin 74 and the inner curved clamp member 76, which sized to receive the stop pin 70.

The outer jaw 56 preferably includes an outer base plate 82, an outer crank pin 84, an outer curved clamp member 86 and an outer pivot pin 88. The outer crank pin 84 extends upward from one side and one end of the outer base plate 82. The outer pivot pin 88 extends downward from the one end and an opposing side of the outer base plate 82. The outer clamp member 86 extends upward from an opposing end and the one side of the outer base plate 82. An outer semi-circular slot 90 is formed in the opposing side of the outer base plate 82 and between the outer crank pin 84 and the outer curved clamp member 86, which sized to receive the stop pin 70. A clamp projection 92 extends outward from the opposing end and opposing side of the outer base plate 82. The jaw actuator 58 preferably includes a jaw base plate 94 and a spring attachment pin 96. The jaw base plate 94 includes an actuation plate 98 and a spring plate 100. One end of the spring plate 100 extends from one end of the actuation plate 98. The spring attachment pin 96 is attached to an opposing end of the spring plate 100. A slide opening 102 is formed in a middle of the actuation plate 98 at substantially one end thereof. An outer slot 104 is formed in one corner at an opposing end of the actuation plate 98 and an inner slot 106 is formed in an opposing corner at the opposing end of the actuation plate 98.

The inner jaw 54 is placed on one side of the base plate 62 and the outer jaw 56 is placed on an opposing side of the base plate 62. The jaw actuator 58 is laid over the inner and outer jaws 54, 56, such that the inner and outer crank pins 74, 84 are received by the inner and outer slots 106, 104, respectively. The slide opening 102 of the jaw actuator 58 receives the pivot boss 68 of the slider base 52. The slider base 52 is slid on to the case slider support 26. The slider cover 60 includes a jaw actuator slot 108 and a spring deflector projection 110. The jaw actuator slot 108 is formed in a bottom of the slider cover 60 and is sized to receive the motion of the jaw actuator 58. The spring deflector projection 110 extends from a side of the slider cover 60. The spring deflector projection 110 prevents an extension spring from interfering with a motion of the inner and outer jaws 54, 56. The slider cover 60 is secured to a top of slider base 52 with at least one fastener (not shown).

Figure 10:
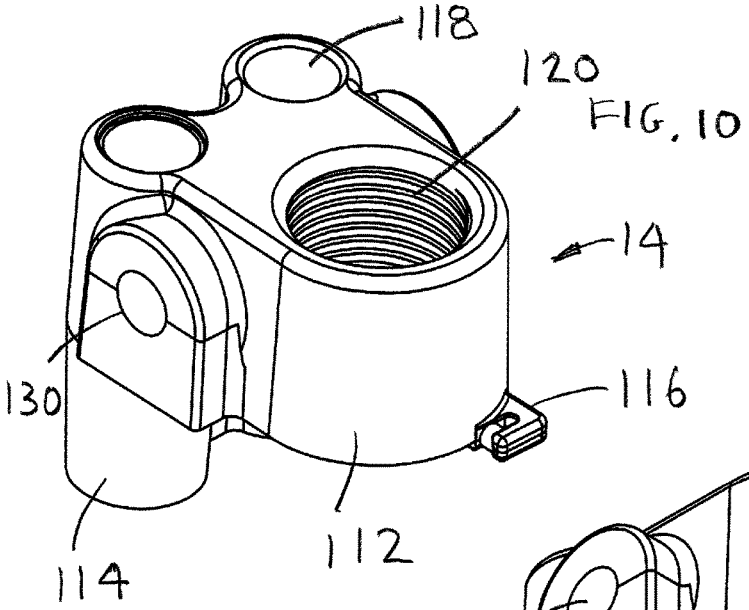
FIG. 10 is a top perspective view of an upper die carrier of an automatic processing press in accordance with the present invention.
Figure 11:
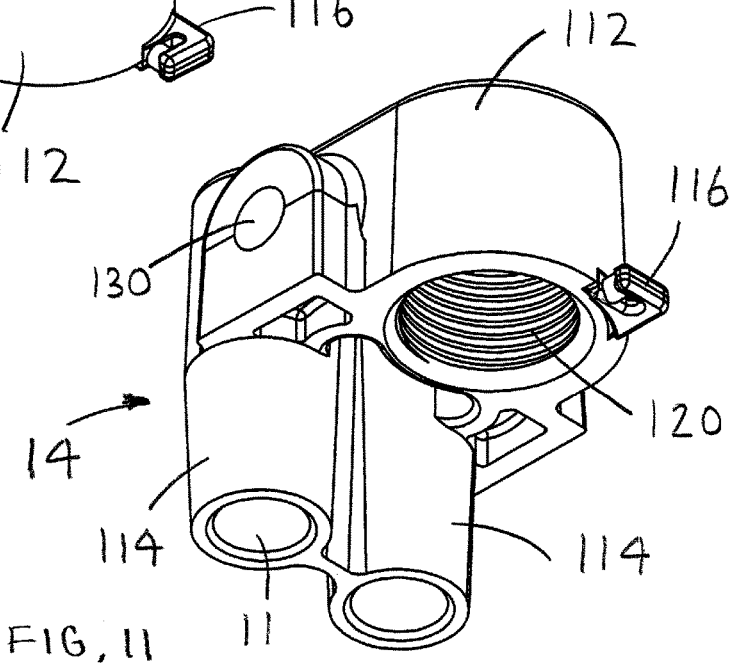
FIG. 11 is a bottom perspective view of an upper die carrier of an automatic processing press in accordance with the present invention.

With reference to FIGS. 10-11, the upper die carrier 14 includes an upper base portion 112, a pair of post bosses 114 and a spring retention projection 116. The post bosses 114 preferably extend downward from upper base portion 112. A post bore 118 is formed through each post boss 114. The post bore 118 is sized to receive one of the pair of support posts 12. An upper threaded receiver 120 is formed through upper die carrier 14 to threadably receive a universal shell holder adapter, a bullet resizing die or a cartridge resizing die. The spring retention projection 116 extends outward from a front of the upper base portion 112. One end of the extension spring 122 is retained on the spring retention projection 116 and the other end is retained on the spring attachment pin 96.

With reference to FIG. 1, the actuation device 16 preferably includes a pair of leverage links 124, a pair of toggle links 126 and a handle member 128. The handle member 128 is retained between one end of the pair of leverage links 124 with a fastener 129. An opposing end of the pair of leverage links 124 are pivotally engaged with one end of the pair of toggle links 126. A pivot hole 130 is formed through the upper base portion 112. A fastener 132 is inserted through the pair of leverage links 124 and the upper base portion 112, such that the upper base portion 112 is pivotally retained between the pair of leverage links 124 and substantially adjacent the opposing end of the pair of leverage links 124. A leverage portion 125 extends backward from each leverage link 124, starting at the fastener 132. An opposing end of the pair of toggle links 126 are pivotally engaged with opposing sides of the base portion 22 of the lower die carrier 10.

Figure 12:
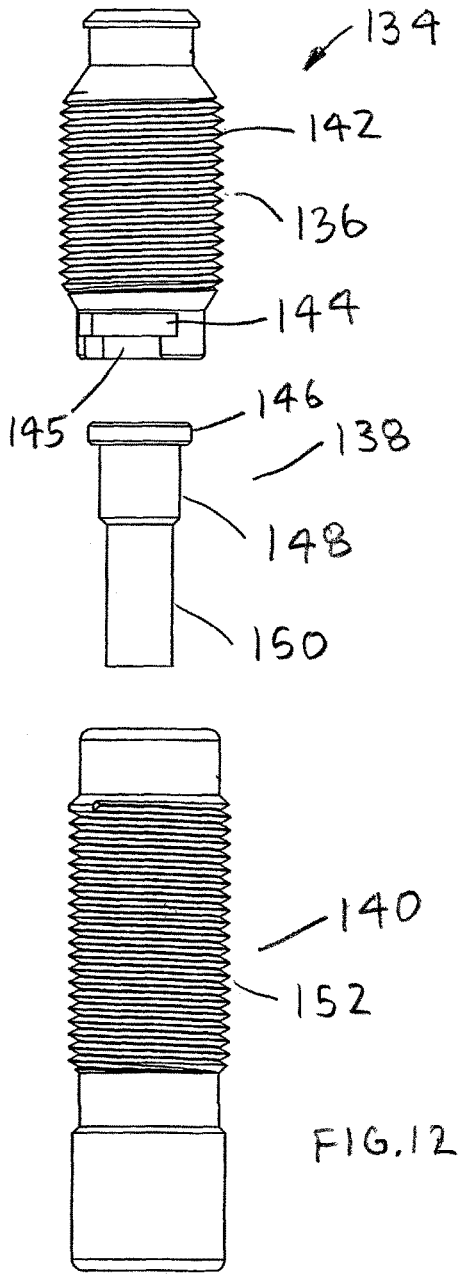
FIG. 12 is an exploded side view of a bullet resizing die system of an automatic processing press in accordance with the present invention.
Figure 13:
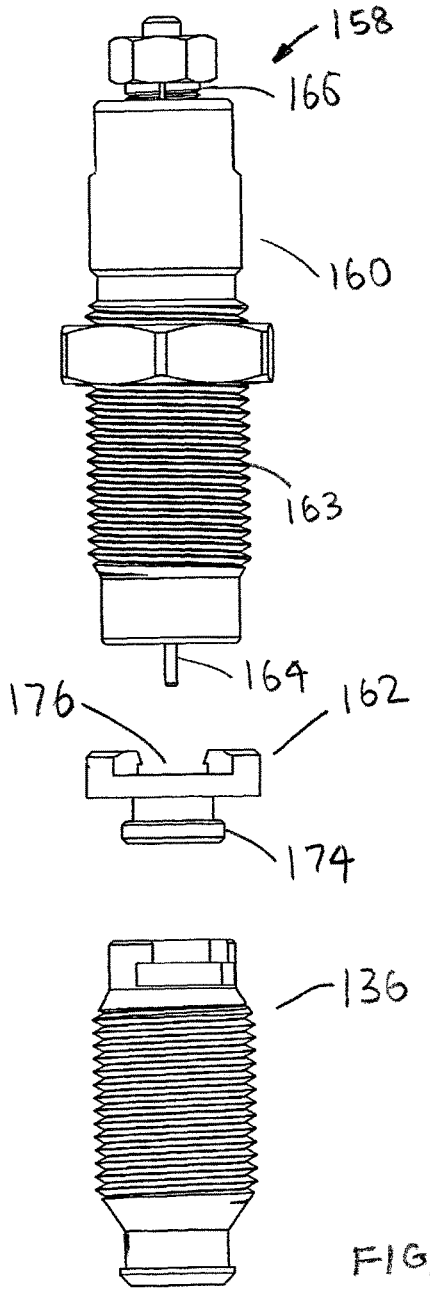
FIG. 13 is an exploded side view of a case resizing system of an automatic processing press in accordance with the present invention.
Figure 14:
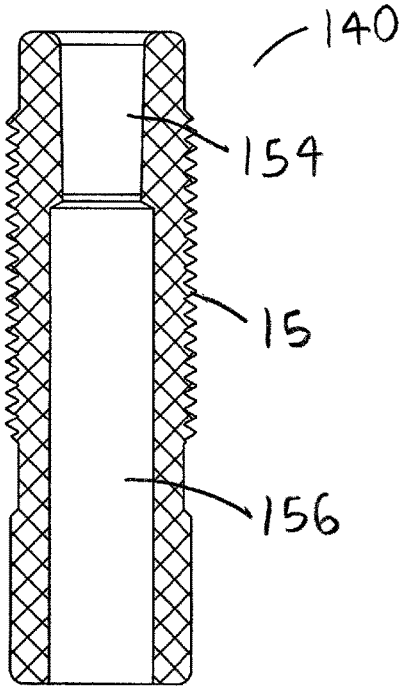
FIG. 14 is a cross sectional view of a bullet resizing die of a case resizing die system of an automatic processing press in accordance with the present invention.
Figure 15:
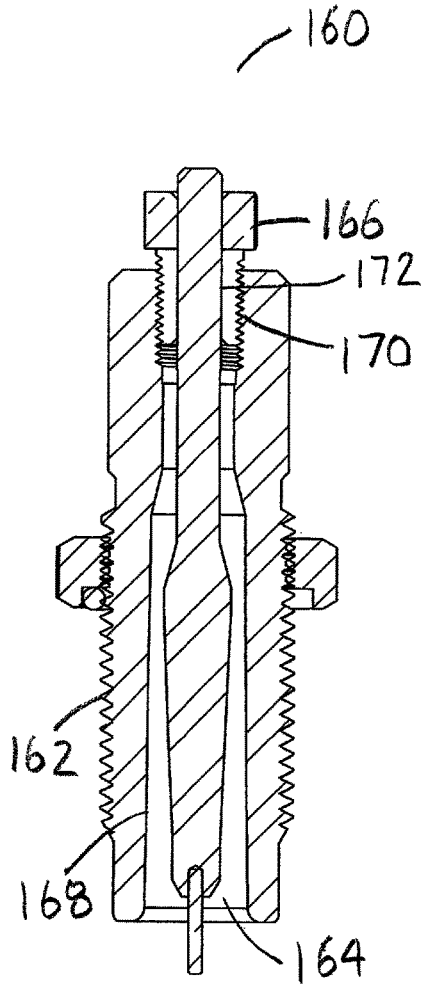
FIG. 15 is a cross sectional view of a cartridge resizing die of a case resizing die system of an automatic processing press in accordance with the present invention.
Figure 16:
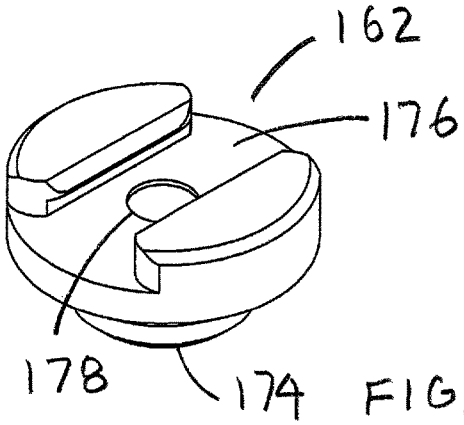
FIG. 16 is a perspective view of a pass through shell holder of a case resizing die system of an automatic processing press in accordance with the present invention.

With reference to FIGS. 12 and 14, a bullet resizing die system 134 preferably includes a universal shell holder adapter 136, a bullet sizer punch 138 and a bullet resizing die 140. The universal shell holder adapter 136 includes a threaded body 142, a retention slot 144 and a retention diameter 145. The threaded body preferably has a ⅞-14 thread. The retention slot 144 is sized to retain a punch flange 146 of the bullet sizer punch 138. The bullet sizer punch 138 includes the punch flange 146, a slot diameter 148 and a punch diameter 150. The slot diameter 148 extends from the punch flange 146 and the punch diameter 150 extends from the slot diameter 148. The slot diameter 148 is sized to mate with the retention diameter 145. The punch diameter 150 is sized to be inserted into an inner diameter of a bullet sizing die 140. The bullet resizing die 140 includes a threaded body 152, a tapered inner diameter 154 and a clearance diameter 156. The tapered inner diameter 154 is tapered to a specific bullet diameter. The clearance diameter 156 extends from a bottom of the tapered inner diameter 154. The universal shell holder adapter 136 and the bullet resizing die 140 are threadably engaged with a threaded die receiver 28 of the lower die carrier 10 or the upper threaded receiver 120 of the upper die carrier 14.

A case resizing die system 158 preferably includes a cartridge resizing die 160, a pass through shell holder 162 and the universal shell holder adapter 136. The cartridge resizing die 160 includes a threaded body 163, a concentrically positioned deprimer punch 164 and a deprimer punch hollow bolt 166. The threaded body includes a punch counter bore 168 formed in one end and a primer threaded tap 170 formed in the opposing end. The deprimer punch hollow bolt 166 includes an inner diameter 172 that is sized to receive concentrically positioned deprimer punch 164. The primer threaded tap 170 is sized to threadably receive the deprimer punch hollow bolt 166. The pass through shell holder 162 includes a retention flange 174, a shell holder slot 176 and a through diameter 178. The shell holder slot 176 is sized to retain a specific size of cartridge casing. The retention flange 174 is sized to be retained by the retention slot 144 of the universal shell holder adapter 136. The universal shell holder adapter 136 and the cartridge resizing die 160 are threadably engaged with a threaded die receiver 28 of the lower die carrier 10 or the upper threaded receiver 120 of the upper die carrier 14.

The automatic feeder magazine 20 preferably includes a feed plate 180, a tube holder 182, a plurality of feed tubes 184 and a threaded stud 186. The feed plate 180 includes a pair of tubes 188, 190 extending from a bottom thereof and a rotation projection 191. Each tube 188, 190 includes two different inner diameters for receiving two different size shells. An anchor cavity 192 is formed in the top of the feed plate 180 to receive and retain one end of the threaded stud 186. The tube holder 182 preferably includes four cylinders 194 for receiving and retaining four feed tubes 184 and a rotation hole 195. Each feed tube 184 includes an inner diameter 196, which is sized to receive the largest cartridge casing used. The tube holder 182 is rotatably retained on the feed plate 180 with the rotation projection 191 inserted into the rotation hole 195. A fastener (not shown) is preferably threaded into the rotation projection 191 to rotatably retain the tube holder 182 on the feed plate 180. The other end of the threaded stud 186 is inserted in the stud hole 50 in the feed boss 48 of the lower die carrier 10 to support the automatic feeder magazine 20, and is retained at the proper height with jamb nuts 198 above and below the feed boss 48.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An automatic processing press comprising:

a lower die carrier includes at least one post bore and a lower threaded die receiver, said lower threaded die receiver is adapted to threadably receive a bullet sizing die or a shell holder adapter;

at least one support post is retained in said at least one lower post bore;

an upper die carrier includes at least one upper post bore and an upper threaded die receiver, said at least one support post is slidably engaged with said at least one upper post bore; and an actuation device is pivotally engaged with said lower die carrier and said upper die carrier, wherein pulling said actuation device causes said upper die carrier to move toward said lower die carrier.

2. The automatic processing press of claim 1, further comprising:

a bullet resizing die system includes a universal shell holder adapter, a bullet sizer punch and a bullet resizing die, said bullet sizer punch is retained in said universal shell holder adapter, said universal shell holder adapter and said bullet resizing die are threadably engaged with either said lower threaded die receiver or said upper threaded die receiver.

3. The automatic processing press of claim 1, further comprising:

a case resizing die system includes a cartridge resizing die, a pass through shell holder and a universal shell holder adapter, said pass through shell holder is retained in said universal shell holder adapter, said universal shell holder adapter and said cartridge resizing die are threadably engaged with either said lower threaded die receiver or said upper threaded die receiver.

4. The automatic processing press of claim 1 wherein:

said actuation device includes a pair of leverage links, a pair of toggle links and a handle member, said handle member is retained between one end of said pair of leverage links, an opposing end of said pair of leverage links are pivotally engaged with said pair of toggle links, said pair of leverage links are pivotally engaged with said upper die carrier, said toggle links are pivotally engaged with said lower die carrier.

5. An automatic processing press comprising:

a lower die carrier includes a base portion and a case slider support, said case slider support extends from said base portion, at least one lower post bore and a lower threaded die receiver are formed in said base portion;

at least one support post is retained in said at least one lower post bore;

an upper die carrier includes at least one upper post bore and an upper threaded die receiver, said at least one support post is slidably engaged with said at least one upper post bore;

a case slider includes an inner jaw and an outer jaw, said case slider is slidably retained on said case slider support;

and an actuation device is pivotally engaged with said lower die carrier and said upper die carrier, wherein pulling said actuation device causes said upper die carrier to move toward said lower die carrier.

6. The automatic processing press of claim 5, further comprising:

a bullet resizing die system includes a universal shell holder adapter, a bullet sizer punch and a bullet resizing die, said bullet sizer punch is retained in said universal shell holder adapter, said universal shell holder adapter and said bullet resizing die are threadably engaged with either said lower threaded die receiver or said upper threaded die receiver.

7. The automatic processing press of claim 5, further comprising:

a case resizing die system includes a cartridge resizing die, a pass through shell holder and a universal shell holder adapter, said pass through shell holder is retained in said universal shell holder adapter, said universal shell holder adapter and said cartridge resizing die are threadably engaged with either said lower threaded die receiver or said upper threaded die receiver.

8. The automatic processing press of claim 5 wherein:

said actuation device includes a pair of leverage links, a pair of toggle links and a handle member, said handle member is retained between one end of said pair of leverage links, an opposing end of said pair of leverage links are pivotally engaged with said pair of toggle links, said pair of leverage links are pivotally engaged with said upper die carrier, said toggle links are pivotally engaged with said lower die carrier.

9. The automatic processing press of claim 5 wherein:

said case slider includes a slider base and a jaw actuator, said inner jaw and said outer jaw are slidably retained on said slider base, said jaw actuator is engaged with said inner and outer jaws, wherein said jaw actuator moves said inner and outer jaws from an closed orientation to an open orientation.

10. An automatic processing press comprising:

a lower die carrier includes a base portion and a case slider support, said case slider support extends from said base portion, at least one lower post bore and a lower threaded die receiver are formed in said base portion;

at least one support post is retained in said at least one lower post bore;

an upper die carrier includes at least one upper post bore and an upper threaded die receiver, said at least one support post is slidably engaged with said at least one upper post bore;

a case slider includes an inner jaw and an outer jaw, said case slider is slidably retained on said case slider support;

an automatic feeder magazine includes a feed plate, a tube holder and a plurality of feed tubes, said plurality of feed tubes are retained in said tube holder, said tube holder is pivotally retained on said feed plate, said feed plate is secured to said lower die carrier; and an actuation device is pivotally engaged with said lower die carrier and said upper die carrier, wherein pulling said actuation device causes said upper die carrier to move toward said lower die carrier.

11. The automatic processing press of claim 10, further comprising:

a bullet resizing die system includes a universal shell holder adapter, a bullet sizer punch and a bullet resizing die, said bullet sizer punch is retained in said universal shell holder adapter, said universal shell holder adapter and said bullet resizing die are threadably engaged with either said lower threaded die receiver or said upper threaded die receiver.

12. The automatic processing press of claim 10, further comprising:

a case resizing die system includes a cartridge resizing die, a pass through shell holder and a universal shell holder adapter, said pass through shell holder is retained in said universal shell holder adapter, said universal shell holder adapter and said cartridge resizing die are threadably engaged with either said lower threaded die receiver or said upper threaded die receiver.

13. The automatic processing press of claim 10 wherein:

said actuation device includes a pair of leverage links, a pair of toggle links and a handle member, said handle member is retained between one end of said pair of leverage links, an opposing end of said pair of leverage links are pivotally engaged with said pair of toggle links, said pair of leverage links are pivotally engaged with said upper die carrier, said toggle links are pivotally engaged with said lower die carrier.

14. The automatic processing press of claim 10 wherein:

said case slider includes a slider base and a jaw actuator, said inner jaw and said outer jaw are slidably retained on said slider base, said jaw actuator is engaged with said inner and outer jaws, wherein said jaw actuator moves said inner and outer jaws from an closed orientation to an open orientation.

15. The automatic processing press of claim 14, further comprising:

an extension spring having one end secured to said jaw actuator and an opposing end secured to said upper die carrier.

* * * * *